United States Patent [19]

Braun et al.

[11] Patent Number: 4,869,438

[45] Date of Patent: Sep. 26, 1989

[54] WIRE COILING APPARATUS WITH A RECOVERY DEVICE FOR A COILED WIRE REEL

[75] Inventors: Hans J. Braun, Düsseldorf; Günter Grenz, Meerbusch; Gerhard Berz, Leverkusen, all of Fed. Rep. of Germany

[73] Assignee: SMS Schloemann-Siemag Aktiengesellschaft, Düsseldorf, Fed. Rep. of Germany

[21] Appl. No.: 255,739

[22] Filed: Oct. 11, 1988

[30] Foreign Application Priority Data

Oct. 9, 1987 [DE] Fed. Rep. of Germany ..... 3734139

[51] Int. Cl.[4] ..... B65H 75/32; B21C 47/04

[52] U.S. Cl. ..... 242/83; 72/146

[58] Field of Search ..... 72/135, 136, 138, 142, 72/143, 146, 148; 242/83, 82, 84

[56] References Cited

U.S. PATENT DOCUMENTS

| | | | |
|---|---|---|---|
| 2,981,494 | 4/1961 | Kovaleski | 242/83 |
| 3,013,742 | 12/1961 | Bittman | 242/83 |
| 3,300,158 | 1/1967 | Strong | 242/83 |
| 3,750,974 | 8/1973 | Dibrell | 242/83 |
| 3,999,718 | 12/1976 | Ziemba | 72/146 |
| 4,411,394 | 10/1983 | Starvaski et al. | 242/83 |

*Primary Examiner*—Stuart S. Levy
*Assistant Examiner*—Steven M. du Bois
*Attorney, Agent, or Firm*—Toren, McGeady & Associates

[57] ABSTRACT

A wire coiling apparatus with a recovery device for a coiled wire reel, including a coiler basket, formed of basket rods arranged on a baseplate which is drivable rotatably around a stationary vertical bearing, and a reel support mandrel that can be lowered upon and lifted off of this baseplate. The reel support mandrel includes a starplate insertable into recesses of the baseplate, and mandrel rods standing on the starplate. The free ends of the mandrel rods are connected with a guide dome and stand between the basket rods of the coiler basket in the inserted position of the reel support mandrel, in which position, the upper free ends of the basket rods are also connectable with the guide dome. The basket rods are fixedly inserted with their lower ends in the baseplate and their outer boundary lines face the wire reel windings, which lines are stressed by the wire reel windings during the coiling process, and extend to be slightly inclined inwards from bottom to top with respect to vertical. The mandrel rods are radially offset to such an extent with respect to the basket rods in the inserted position of the reel support mandrel that the wire reel windings do not contact the outer boundary lines of the mandrel rods. Herein the free ends of the basket rods are fixedly connected with centering bolts, which are insertable into centering recesses of the guide dome. The guide dome can be coupled with a retaining bearing, along its central axis, which bearing can be fixed so as to be stationary during the coiling operation.

8 Claims, 2 Drawing Sheets

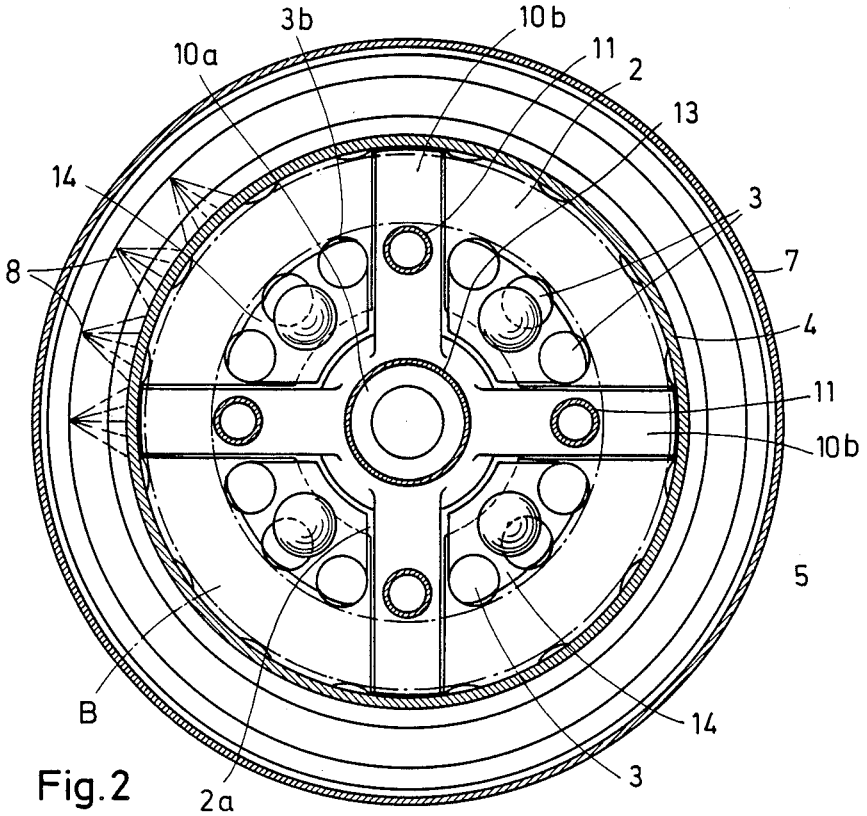
Fig.2
Fig.3
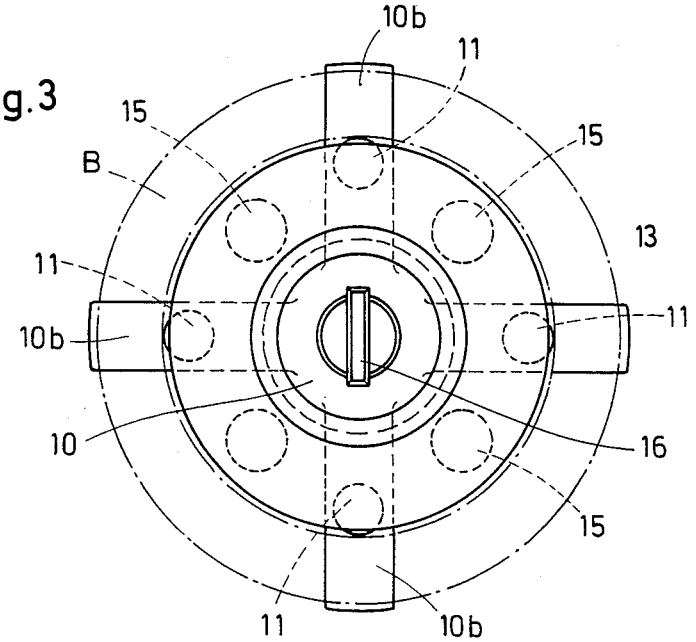

WIRE COILING APPARATUS WITH A RECOVERY DEVICE FOR A COILED WIRE REEL

BACKGROUND OF THE INVENTION

1. Field of the Invention

The present invention is directed to a wire coiling apparatus with a recovery device for a coiled wire reel, comprising a reel basket formed by basket rods standing at right angles on a base-plate that is rotatably drivable around a stationary vertical bearing and a reel support mandrel which can be lowered from the top upon and lifted off of the baseplate consisting of a star-shaped plate insertable into recesses in the baseplate, mandrel rods standing on this star plate and a guide dome connecting the free ends of the mandrel rods. The mandrel rods in the inserted position stand in between the basket rods so that the upper free ends of the basket rods are connectable with the guide dome.

Two fundamental problems are encountered in the operation of wire coiling mechanisms of this type: If greater reel weights with correspondingly greater reel height are coiled on the coiled basket, then longer basket rods are required. With such longer basket rods, centrifugal force produces bending stresses at the clamping point of the rods in the baseplate, which can no longer be carried if the construction and dimensioning of the basket rods specified in the design are observed. The other problem resides in the difficulty in pulling the finished coiled wire reel vertically upwards from the basket rods by means of the reel support mandrel introduced in between the basket rods of the reel basket, since the wire coils embrace the basket rods with a more or less great tension and this tension is additionally increased because of cooling and contraction of the wire reel.

In a known design of a wire coiler (EP - PS 74 760), these two problems are solved by articulating the basket rods in such a way on the baseplate, that they are pivotable from their vertical coiling position forming the coiler basket inwardly into an external non-coiling position. Also, that locking elements with wedge arrangements are provided at the support dome, which lock the free ends of the basket rods with the guide dome and thus retain it in their vertical coiling position, and then subsequently effect a pivoting motion of the basket rods inward out of the coiling position for the wire reel extraction process. Thus created is the possibility of recovering the coiled wire reel without difficulty by means of the reel support mandrel from the coiler basket and to bring same upwards out of the wire coiling apparatus, since by pivoting the basket rods inward the squeezing effect of the wire coils is cancelled.

The disadvantages of this known embodiment are to start off with that the basket rods cannot be inserted tightly into the baseplate, instead they require a more or less unstable guide rod fastening to the baseplate and furthermore that the free ends of the basket rods, as well as the corresponding segments of the guide dome of the reel support mandrel require comparatively complicated and technically cumbersome locking elements which additionally have to be provided for every one of the basket rods. The satisfactory cooperation of these locking elements is impaired by the heat radiated from the hot wire reel, which easily leads to deformation of the locking elements. Furthermore, the scale falling upon the baseplate from the wire during the coiling process can very easily penetrate into the gaps within the baseplate required for the movement of the basket rods, thereby interfering with the free pivoting motion of the basket rods. The lack of a firm clamping of the basket rods in the baseplate leads, in spite of the locking of the free ends in the guide dome, to a shaking movement of the whole machinery during the coiling process which limits the coilable reel heights.

SUMMARY OF THE INVENTION

The invention is based upon the task of doing away with the above-mentioned disadvantages and difficulties and additionally to create a possibility, by a refinement of the invention, of completely avoiding the shaking motion during the operation of the coiling apparatus.

This task is solved by inserting the lower ends of the basket rods tightly into the baseplate and having the outer boundary lines facing the wire reel windings and acted upon by same during the coiling process extend so as to be slightly inclined vertically inwards from bottom to top. Additionally, the mandrel rods are arranged so as to be offset radially inwards to such an extent with respect to the basket rods, so that the wire reel windings do not contact the outer boundary lines of these mandrel rods. The free ends of the basket rods are tightly connected with centering bolts insertable into recesses of the guide dome with the central axes of said centering bolts extending parallel to the central axes of the basket rods. The basket rods can herein also have a circular cross-section tapering from the bottom towards the top, which transits into a flattened arc-shaped extent with larger radius in the region in which they are acted upon by the wire windings.

This design achieves that the basket rods whose lower end are tightly clamped in the baseplate, can be connected during the coiling operation with their upper ends to the support dome without the necessity of articulated and splined connections; and after the coiling operation of the wire reel is finished, same can be lifted vertically out of the coiling apparatus upwards by the reel support mandrel consisting of the baseplate, the mandrel rods and the guide dome, whereby the centering pins slide vertically out of the recesses in the guide dome. The tight contact of the wire reel windings at the outer boundary lines of the basket rods releases automatically during the lifting out movement, since these boundary lines extend slightly inclined inwardly to the vertical from the bottom to the top.

If, as the invention further provides, the guide dome is coupled along its central axis with a retaining bearing which can be fixed so as to be stationary during the coiling process, which retaining bearing is pivotable in a horizontal plane into and out of a coupling position or possibly can also be lowered vertically from the top into the coupling position and lifted out of the coupling position, then there is created a two-sided support of the coiling basket together with the reel support mandrel inserted into same, constituting a kind of support which prevents the otherwise unavoidable shaking motion from occurring.

The invention is explained with particularity with the help of the embodiment example depicted in the drawing.

BRIEF DESCRIPTION OF THE DRAWING

FIG. 2, is a section along the line A—A in FIG. 1, and FIG. 3, is a plan view of the reel support mandrel lifted out of the coiler basket.

DETAILED DESCRIPTION OF THE PREFERRED EMBODIMENTS

Figure 1:
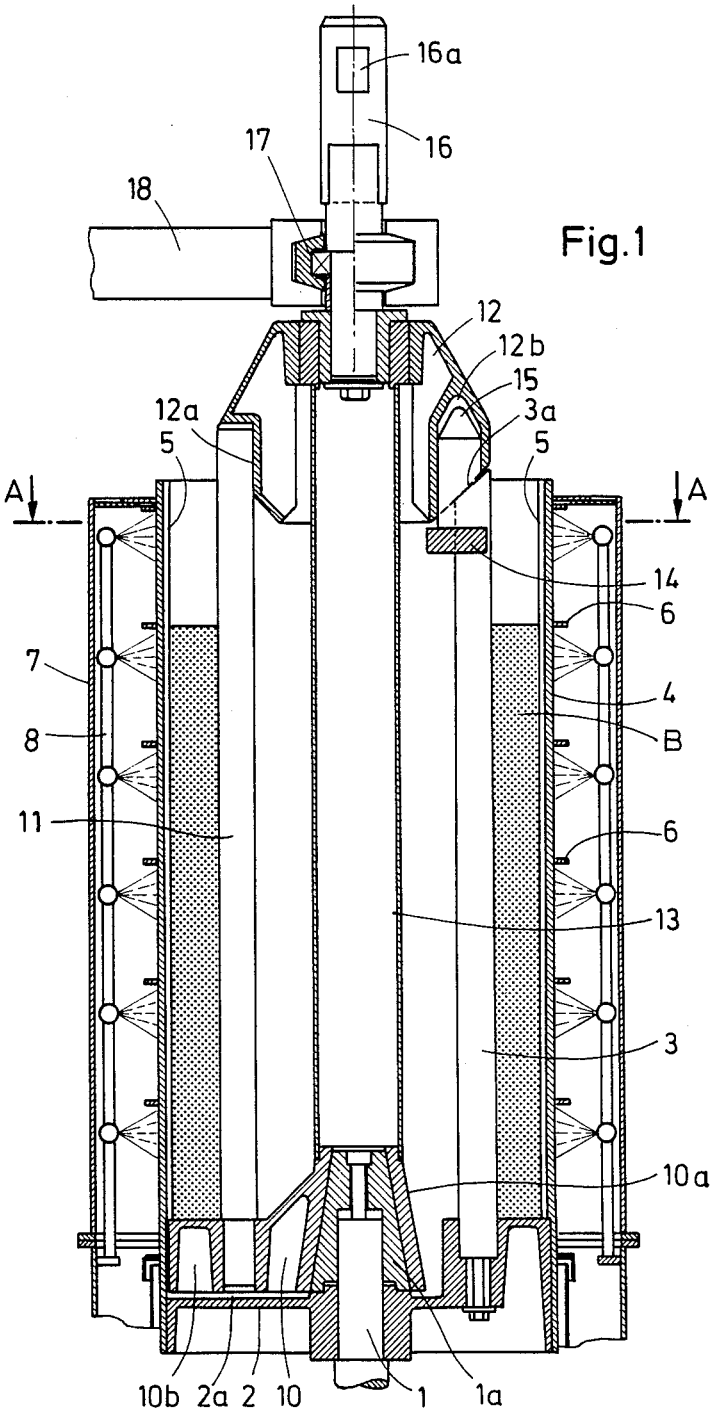
FIG. 1, shows a wire coiling apparatus pursuant to the present invention in axial section.

As can be discerned from FIG. 1, the wire coiling apparatus consists of a baseplate 2 seated on a drive axle 1, which together with the basket rods 3 inserted into it forms the coiler basket. Also connected with the baseplate 2, is a cylinder 4 surrounding the basket rods 3 with a spacing in between, with axially parallel running contact strips 5 arranged at its inside wall, and whose outer wall comprises annular reinforcements 6. The thus formed coiler basket 2, 3, 4 rotates in a housing 7, in which spraying arrangements 8 for the application of cooling liquid upon the cylinder outer wall are arranged so as to be spaced from the cylinder 4 (compare also FIG. 2).

As FIG. 1 in connection with FIGS. 2 and 3 shows, the reel support mandrel is insertable into the coiler basket 2, 3, 4. The mandrel consists of a starplate 10 which is placed with its conical hub upon a cone 1*a*, which his fixedly connected with the drive axle 1. Mandrel rods 11 are inserted with their lower ends into star arms 10*b* of the starplate 10, which in this case is designed as a plate having four arms. The mandrel rods 11 displaceably engage with their upper ends into edge recesses 12*a* of a guide dome 12, which is supported by a tubular rod 13 placed upon the cone 10*a* of the starplate 10. The star arms 10*b* of the starplate 10 (FIGS. 1 and 2) lie in recesses 2*a* of the baseplate 2, which extend correspondingly in a star-shaped manner, when the reel support mandrel is inserted into the coiler basket.

Three each of the total of 12 basket rods 3, thus a quarter of the total number in the embodiment example, are respectively connected with each other at their upper ends by segmented plates 14 and their front faces 3*a* extend inwardly in an inclined manner towards the axis of rotation of the coiler basket. Each of these segmented plates 14 carries a centering bolt 15 which is offset symmetrically centrally, radially inwards, with the central axis of the centering bolts extending parallel to the central axes of the basket rods 3. This centering bolt is (FIG. 1) insertable into centering recesses 12*b* of the guide dome 12. The guide dome 12 carries furthermore a suspending bolt 16 on its upper side with an eyelet 16*a* and a conical annulus 17 supported on the bolt circumference. A retaining arm 18 which can be pivoted horizontally, can be clamped on the conical annulus 17 in a stationary manner externally of the guidance dome 12.

In the coiling apparatus position reflected in the FIGS. 1 and 2, the basket rods 3 standing upon the baseplate 2, rotate together with the mandrel rods 11 located between them and standing upon the starplate 10 and with the guide dome 12, retained by the retaining arm 18 clamped on the conical annulus 17 placed on the suspending bolt 16. Thus, the reel B is formed between the contact strips 5 of the basket peripheral surface 4 and the basket rods 3. The wire reel windings act upon, or stress, the outer boundary lines 3*b* (compare FIG. 2) of the basket rods, which, in this case with a circular cross-section of the basket rods, extend to be slightly inclined inwards with respect to the vertical from the bottom to the top, wherein the circular cross-section tapers from the bottom to the top and the region of the action of the windings is flattened, meaning it transits into an arc-shaped extent with larger radius. After finish winding of the wire reel designated with B, the retaining arm 18 is pivoted away and the suspending bolt 16 is connected to an elevating device in a non-depicted manner. The elevating device lifts the reel support mandrel (compare FIG. 3) consisting of the starplate 10, the mandrel rods 11, the tubular rod 13, and the guide dome 12, together with the reel B resting upon the starplate 10, vertically upwards from the coiler basket formed by the baseplate 2, the basket rods 3 and the basket peripheral surface 4. The outer windings of the reel B glide along the contact strips 5 and the inner windings are held by the mandrel rods 11 releasing same from the action effect regions of the basket rods 3. The connection between the guide dome 12 and the centering bolts 15 is herein released by these centering bolts 15 sliding out of the centering recesses 12*b*. The support mandrel 10, 11, 12 is then transported away together with the reel B in a manner not pertaining to the invention and then an equally designed additional reel support mandrel can be inserted vertically from the top into the coiler basket 2, 3, 4 in order to repeat the coiling process described above.

We claim:

1. A wire coiling apparatus with a recovering device for a coiled wire reel, comprising:

a coiler basket formed by basket rods standing vertically upon a baseplate, said coiler basket being rotatably drivable around a stationary vertical bearing; and a reel support mandrel which is lowerable upon said baseplate from above and liftable thereoff, said reel support mandrel including a starplate insertable into recesses in said baseplate, mandrel rods provided so as to stand on said starplate and have free ends, and a guide dome provided so as to connect the free ends of said mandrel rods, the mandrel rods being further provided so as to stand in between the basket rods in an inserted position in which the upper free ends of the basket rods are connectable with the guide dome, said basket rods being fixed with their lower ends into said baseplate and having outer boundary lines which face wire reel windings so as to be stressed by same during the coiling process and extend slightly inclined vertically inwards from bottom to top, said mandrel rods being arranged to be radially offset inwards with respect to said basket rods to an extent so that the wire reel windings do not contact outer boundary lines of said mandrel rods, free ends of the said basket rods being fixedly connectable with centering bolts which are insertable into centering recesses of said guide dome, the central axes of said centering bolts extending parallel to the central axes of said basket rods.

2. A wire coiling apparatus according to claim 1; and further comprising a retaining bearing coupled to said guide dome along its central axis, said retaining bearing being rigidly fixable so that it is stationary during the coiling process.

3. A wire coiling apparatus according to claim 2; and further comprising a retaining arm connectable with said retaining bearing and pivotable in a horizontal plane into and out of a coupling position.

4. A wire coiling apparatus according to claim 2, wherein said the retaining bearing is selectively lowerable into and liftable out of a coupling position.

5. A wire coiling apparatus according to claim 1, wherein said the basket rods have a circular cross-section tapering from the bottom to the top, which circular cross-section forms in a region of an action effect of the wire reel windings in a flattened manner into an arc path with a greater radius.

6. A wire coiling apparatus according to claim 1; and further comprising a segment shaped segmented plate provided so as to carry one of said centering bolts, the free ends of a group of said basket rods standing next to each other and whose end faces terminate beneath the guide dome being connected with said segment shaped segmented plate.

7. A wire coiling apparatus according to claim 1, said reel support mandrel further including a central support tube provided so as to connect said guide dome with said star plate so that the free ends of said mandrel rods are inserted into edge recesses of said guide dome so as to be longitudinally displaceable.

8. A wire coiling apparatus according to claim 6, wherein four of said segmented plates are provided, and respectively one-quarter of the total number of basket rods is connected with each one of said four segmented plates.

* * * * *